United States Patent [19]

Hardwick

[11] Patent Number: 4,749,111

[45] Date of Patent: Jun. 7, 1988

[54] FABRIC SLEEVE INVERSION DEVICE

[75] Inventor: Gary L. Hardwick, Prairie Village, Kans.

[73] Assignees: J. Evans Keller, Fresno, Calif.; John T. Hauber, Kansas City, Mo.

[21] Appl. No.: 66,193

[22] Filed: Jun. 25, 1987

[51] Int. Cl.[4] ..... A41H 31/00; A41H 43/00

[52] U.S. Cl. ..... 223/42

[58] Field of Search ..... 211/105.1; 223/39, 40, 223/41, 42, 100, 103

[56] References Cited

U.S. PATENT DOCUMENTS

| | | | |
|---|---|---|---|
| 478,827 | 7/1892 | Stott | 223/103 |
| 890,885 | 6/1908 | Stuart et al. | 223/39 X |
| 1,562,345 | 11/1925 | Leach et al. | 223/42 |
| 2,364,649 | 12/1944 | Palliser | 66/117 |
| 2,702,544 | 2/1955 | Hanington | 223/40 X |
| 2,868,423 | 1/1959 | Patterson et al. | 223/42 |
| 3,643,840 | 2/1972 | LeBlane | 223/42 |
| 4,083,479 | 4/1978 | Borden | 223/100 |
| 4,280,641 | 7/1981 | Eacret | 66/1 R X |

FOREIGN PATENT DOCUMENTS

| | | | |
|---|---|---|---|
| 198100 | 5/1923 | United Kingdom | 211/105.1 |
| 315776 | 7/1929 | United Kingdom | 211/105.1 |

*Primary Examiner*—Robert R. Mackey

*Attorney, Agent, or Firm*—Kokjer, Kircher, Bradley, Wharton, Bowman & Johnson

[57] ABSTRACT

A device which assists in the inversion of fabric sleeves such as cloth belts and straps. A rigid rod is encapsulated in a high friction cover which frictionally grips the inside of the fabric sleeve to prevent it from sliding while it is being inverted. The opposite ends of the rod are provided with smooth end caps which have tapered or rounded noses to facilitate insertion of the device into the fabric sleeve.

6 Claims, 1 Drawing Sheet

FABRIC SLEEVE INVERSION DEVICE

BACKGROUND AND SUMMARY OF THE INVENTION

This invention relates generally to sewing devices and more particularly to a device that finds use in the inversion of sewn fabric sleeves.

In recent years, the sewing of cloth belts and "spaghetti" cloth straps has become increasingly popular. These articles are created from a fabric strip which is folded on itself and stitched to generally take on the shape of a sleeve. In order to conceal the sewn seam and especially the fabric material that extends beyond the seam, the sleeve-like belt or strap must be inverted. In the past, inversion has been carried out by using a long narrow rod which is extended through the sleeve to provide a mandril over which the sleeve can be pulled during the inversion process. Because the fabric material can easily slide along the surface of the rod, considerable time is usually required to complete the inversion. Four or five minutes is typical.

It is thus apparent that a need exists for a device to facilitate and expedite the inversion of sleeve-like fabric belts and straps, as well as other fabric sleeves. It is the principal goal of the present invention to meet that need.

More specifically, the invention provides a device or appliance that includes a rigid metal rod encapsulated by a high friction cover formed from rubber or another material which is able to frictionally grip the inside of the fabric sleeve after the rod has been extended through the sleeve. This gripping action greatly facilitates the inversion of the sleeve because it permits one end of the sleeve to be initially inverted and pulled back along the remainder of the sleeve without slipping of the sleeve on the high friction rubber surface. As a consequence, cloth belts and straps can usually be inverted in a span of only fifteen or twenty seconds compared to the four or five minutes that has previously been required.

End caps are glued or otherwise secured on the opposite ends of the rod. The end caps may be constructed of vinyl or another relatively smooth material in order to provide easy entry of the rod into the end of the fabric sleeve. In addition, the end caps are tapered or rounded to further facilitate the entry of the rod into the sleeve.

DETAILED DESCRIPTION OF THE INVENTION

In the accompanying drawing which forms a part of the specification and is to be read in conjunction therewith and in which like reference numerals are used to indicate like parts in the various views.

Figure 1:
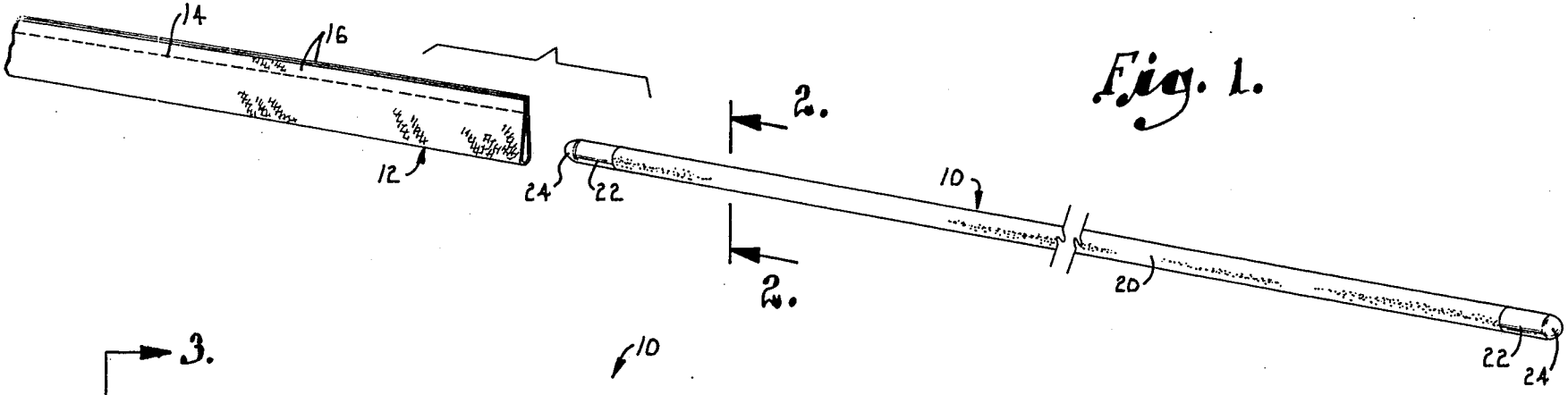
FIG. 1 is an exploded perspective view showing the manner of application of the device of the present invention to a cloth strap, with the break lines indicating continuous length of the device.
Figure 3:
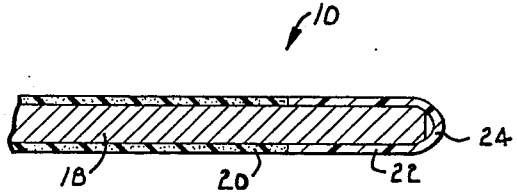
FIG. 3 is a fragmentary sectional view taken generally along line 3—3 of FIG. 2 in the direction of the arrows.

Referring now to the drawing in more detail, the present invention provides a device or appliance 10 which is used to invert a sewn fabric sleeve such as the cloth strap generally identified by numeral 12. The strap 12 is formed from a fabric strip which is folded on itself and stitched along a stitch line 14 which joins the edge portions of the folded fabric strip. In order to conceal the seam 14 and especially the flaps 16 located beyond the seam, the strap 12 must be inverted so that the flaps 16 are located inside of the sleeve.

Figure 2:
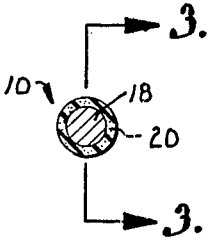
FIG. 2 is a sectional view on an enlarged scale taken generally along line 2—2 of FIG. 1 in the direction of the arrows.

As best shown in FIG. 2, the device 10 includes an elongate rod 18 which may be constructed of metal or any other suitably rigid material. The rod 18 is a straight member and is preferably cylindrical, and it serves to provide the device 10 with rigidity and structural strength. The rod 18 is covered along substantially its entire length by a cover 20 which provides a high friction outer surface for gripping of the inside of the fabric sleeve. The cover 20 is cylindrical and fits closely on the rod 18. Preferably, cover 20 is constructed of latex rubber, neoprene rubber or another rubber substance having a sufficient coefficient of friction to prevent the strap 12 from sliding while it is being inverted on the device 10. High friction substances other than rubber can be used if desired.

The cover 20 terminates short of the opposite ends of rod 18. The end portions of the rod are covered with respective end caps 22 which are identical to one another. The end caps fit closely on the ends of rod 18 and are glued or otherwise suitably secured to the rod. The outside diameter of each end cap 22 is identical to that of the cover 20 so that the end caps and cover provide a continuous surface. The ends of the end caps are butted against the ends of the cover 20. The end caps are formed from vinyl or another relatively smooth material having a coefficient of friction much lower than that of the cover 20. The smooth, low friction surface provided by each end cap facilitates entry of the device 10 into the end of the strap 12 and other fabric sleeves. In addition, each end cap 22 is tapered or rounded at 24 on its end or nose. The tapered or rounded configuration of each nose 24 also facilitates entry of the appliance into the fabric sleeve.

Figure 5:
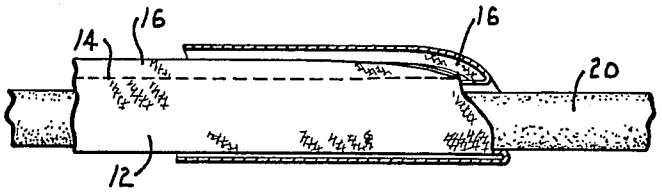
FIG. 5 is a fragmentary elevational view, partially in section and on an enlarged scale, showing the cloth strap partially inverted on the device.
Figure 4:
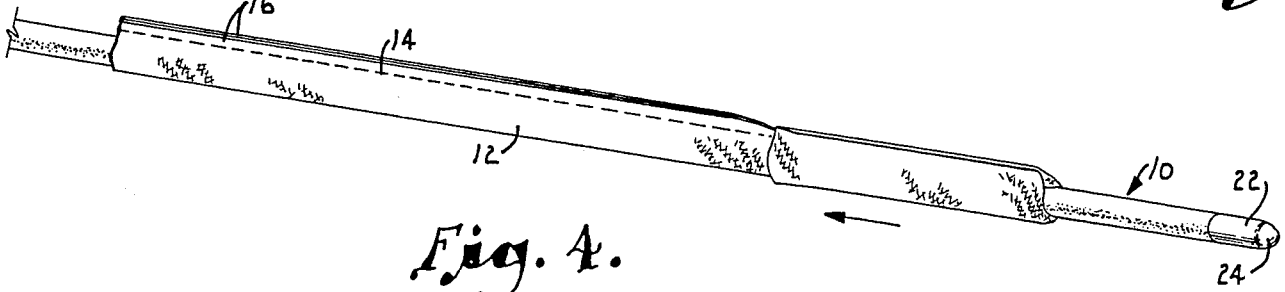
FIG. 4 is a fragmentary perspective view showing the device extended through the cloth strap, with the strap being partially inverted on the device.

In use of the device 10, the cloth strap 12 is first sewn into the shape of a sleeve, and the device 10 is then inserted by hand into and through the strap 12 which is also held in the hand. The strap is inverted by hand on the device 10, initially by grasping one end of the strap and rolling it outwardly on itself in a manner shown in FIGS. 4 and 5. Once the end portion of the strap has been inverted in this manner, continued pulling of the inverted end toward the opposite end results in progressive inversion of the strap until it has been turned completely inside out. The device 10 can then be pulled out of the inverted strap, and the flaps 16 are then disposed inside of the inverted sleeve where they are not noticeable.

The high friction surface provided on the outside of the cover 20 grips against the inside surface of the sleeve during the inversion process, and this frictional gripping action of the device prevents the sleeve from sliding along the device as it is being inverted. Because of the gripping action provided by the device, the sleeve can be quickly and easily inverted in a matter of fifteen or twenty seconds, depending upon the size and length of the sleeve. This is to be compared with the four or five minutes that has been required in the past to invert fabric sleeves of this type.

It is contemplated that the device 10 will be provided in a variety of diameters in order to accommodate fabric sleeves of various diameters. For example, the outside diameter of the device may be ⅛ inch in order to accommodate relatively small fabric sleeves such as small "spaghetti" cloth straps. Larger diameters of ⅜ inch or ½ inch can be provided to accommodate larger cloth straps and/or belts. The device should be somewhat smaller in diameter than the fabric sleeve. The device 10 can be provided in various lengths, although it is not necessary for the device to be extended completely through the fabric sleeve since it can be moved longitudinally with respect to the sleeve after part of the sleeve has been inverted. Accordingly, a single length device can be used to invert fabric sleeves having virtually any length.

From the foregoing, it will be seen that this invention is one well adapted to attain all the ends and objects hereinabove set forth together with other advantages which are obvious and which are inherent to the structure.

It will be understood that certain features and subcombinations are of utility and may be employed without reference to other features and subcombinations. This is contemplated by and is within the scope of the claims.

Since many possible embodiments may be made of the invention without departing from the scope thereof, it is to be understood that all matter herein set forth or shown in the accompanying drawings is to be interpreted as illustrative and not in a limiting sense.

Having thus described the invention, I claim:

1. A device for use in inverting a fabric sewn in the general shape of a sleeve open at opposite ends thereof, said device comprising:

an elongate rigid metal rod having opposite ends and a size to be inserted into the sleeve;

a cover fitting closely on said rod and extending substantially the complete length thereof, said cover having a cylindrical outer surface providing a high friction surface for frictionally holding the inside of the sleeve while same is being inverted; and a pair of end caps on the respective opposite ends of said rod, each end cap having a cylindrical outer surface of substantially the same diameter as said cover and a lower coefficient of friction than that of the cover to facilitate entry of the device into and through the sleeve.

2. A device as set forth in claim 1, wherein each said end cap has a smoothly tapered end.

3. An appliance for use in the inversion of a sewn fabric sleeve having open opposite ends, said appliance comprising:

an elongate rigid metal rod having a length dimension defined between opposite ends of the rod and a diameter less than the sleeve diameter;

a frictional cover encapsulating said rod and extending substantially between the opposite ends thereof, said cover having a cylindrical outer surface presenting high friction for frictional gripping of the inside surface of the fabric sleeve to facilitate inversion of the sleeve with the rod extended therethrough; and an end cap on each end of said rod, each cap having an exposed cylindrical surface smoother than and of the same diameter as said outer surface of the cover to facilitate entry of the rod into the fabric sleeve.

4. An appliance as set forth in claim 3, wherein each end cap has a tapered end.

5. A device to facilitate inversion of a sleeve formed from fabric sewn with a seam extending longitudinally on the sleeve, said device comprising:

an elongate metal rod having a substantially straight configuration and opposite ends, said rod having a diameter less than the sleeve;

a rubber cover fitting closely on said rod and extending substantially between the opposite ends thereof, said cover presenting a cylindrical, high friction outer surface for frictionally gripping the inside surface of the sleeve during inversion of the sleeve; and a pair of end caps secured on the respective ends of said rod and having exposed cylindrical surfaces smoother than the frictional surface of the cover and equal in diameter to the cover to facilitate entry of the rod into and through the sleeve.

6. A device as set forth in claim 5, wherein each end cap has a rounded end.

* * * * *